US011203039B2

(12) United States Patent
Irii et al.

(10) Patent No.: US 11,203,039 B2
(45) Date of Patent: Dec. 21, 2021

(54) ACOUSTIC-ELECTRIC TRANSDUCER

(71) Applicant: Audio-Technica Corporation, Tokyo (JP)

(72) Inventors: Koichi Irii, Tokyo (JP); Mika Yoshino, Tokyo (JP); Kosumo Miyauchi, Tokyo (JP); Hiroshi Akino, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 16/895,388

(22) Filed: Jun. 8, 2020

(65) Prior Publication Data

US 2020/0398310 A1 Dec. 24, 2020

(30) Foreign Application Priority Data

Jun. 19, 2019 (JP) ..... JP2019-113442

(51) Int. Cl.
*B06B 1/02* (2006.01)
*H04R 5/033* (2006.01)

(52) U.S. Cl.
CPC ..... *B06B 1/0223* (2013.01); *H04R 5/0335* (2013.01); *H04R 2400/01* (2013.01)

(58) Field of Classification Search
CPC ..... B06B 1/0223; H04R 5/0335; H04R 2400/01; H04R 1/083; H04R 29/004; H04R 3/00; H04R 2420/00
USPC ..... 367/137
See application file for complete search history.

(56) References Cited

U.S. PATENT DOCUMENTS

| | | | |
|---|---|---|---|
| 5,353,347 | A | 10/1994 | Irissou et al. |
| 6,681,020 | B1 | 1/2004 | Papopoulos |
| 6,751,316 | B1 | 6/2004 | Gligoric |

FOREIGN PATENT DOCUMENTS

| | | | |
|---|---|---|---|
| EP | 3 703 258 | A1 | 9/2020 |
| GB | 2 342 798 | A | 4/2000 |
| GB | 2 344 711 | A | 6/2000 |
| JP | H07 58811 | A | 3/1995 |
| JP | 2003-188967 | A | 7/2003 |

OTHER PUBLICATIONS

European Search Report, EP20180246, dated Nov. 11, 2020.

*Primary Examiner* — Daniel L Murphy
(74) *Attorney, Agent, or Firm* — W&C IP

(57) ABSTRACT

An acoustic-electric transducer includes a connection part that has a first connection point able to contact a first contact in a terminal for processing the electrical signal, and a second connection point able to contact a second contact having a potential lower than the potential of the first contact, a microphone that transduces a sound inputted from an external source into an electrical signal, a changeover switch that switches between a non-mute state where the electrical signal is outputted to the terminal and a mute state where the electrical signal is not outputted to the terminal, and a current control circuit that makes a current flow between the first contact and the second contact until a predetermined time passes from the time when the connection part is connected to the terminal and reduces the current flowing between the first contact and the second contact after the predetermined time passes, the current control circuit being provided between the changeover switch and the connection part.

14 Claims, 3 Drawing Sheets

ACOUSTIC-ELECTRIC TRANSDUCER

CROSS-REFERENCE TO RELATED APPLICATIONS

The present application claims priority to the Japanese Patent Application number 2019-113442, filed on Jun. 19, 2019. The contents of this application are incorporated herein by reference in their entirety.

BACKGROUND OF THE INVENTION

The present invention relates to an acoustic-electric transducer for transducing a sound into an electrical signal.

Conventionally, a headset with a switch to mute an audio output from a microphone is known (see, for example, Japanese Unexamined Patent Application Publication No 2003-188967).

A terminal capable of connecting an acoustic-electric transducer such as a microphone or a headset has a connection detection function for detecting that the acoustic-electric transducer is connected. This connection detection function is for detecting the connection of the acoustic-electric transducer by detecting a change in a voltage due to a current flowing through the acoustic-electric transducer when a plug of the acoustic-electric transducer is connected.

However, in a conventional circuit configuration, the current does not flow if the acoustic-electric transducer in the mute state is connected to the terminal, and the terminal cannot detect that the microphone is connected by using the connection detection function. Therefore, even if the microphone or the headset is connected to the terminal, the terminal does not detect them.

BRIEF SUMMARY OF THE INVENTION

The present invention focuses on these points, and an object of the present invention is to provide an acoustic-electric transducer that allows the terminal to detect that the acoustic-electric transducer is connected even if the acoustic-electric transducer in the mute state is connected to the terminal.

An acoustic-electric transducer of an aspect of the present invention is an acoustic-electric transducer for transducing a sound into an electrical signal that includes a connection part that has a first connection point able to contact a first contact in a terminal for processing the electrical signal, and a second connection point able to contact a second contact having a potential lower than the potential of the first contact, an acoustic-electric transducing part that transduces a sound inputted from an external source into an electrical signal, a changeover switch that switches between a non-mute state where the electrical signal is outputted to the terminal and a mute state where the electrical signal is not outputted to the terminal, and a current control circuit that makes a current flow between the first contact and the second contact until a predetermined time passes from the time when the connection part is connected to the terminal and reduces the current flowing between the first contact and the second contact after the predetermined time passes, the current control circuit being provided between the changeover switch and the connection part.

DETAILED DESCRIPTION OF THE INVENTION

Hereinafter, the present invention will be described through exemplary embodiments of the present invention, but the following exemplary embodiments do not limit the invention according to the claims, and not all of the combinations of features described in the exemplary embodiments are necessarily essential to the solution means of the invention.

An Outline of an Acoustic-Electric Transducer 1

Figure 1:
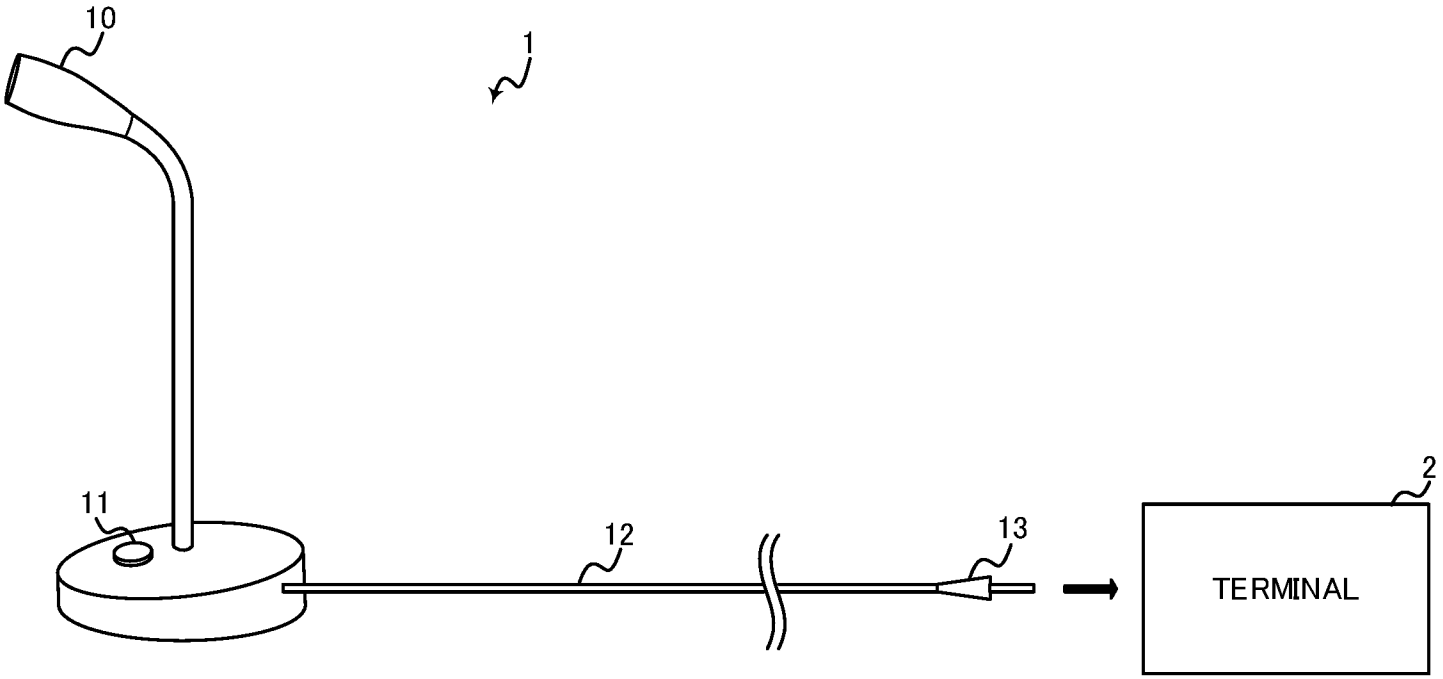
FIG. 1 shows a configuration of an acoustic-electric transducer according to the embodiment.

FIG. 1 shows a configuration of an acoustic-electric transducer 1 according to the embodiment. The acoustic-electric transducer 1 is a device for transducing a sound into an electrical signal and is, for example, a microphone device. The acoustic-electric transducer 1 may be other devices such as a headset that is attached to a user's head. The acoustic-electric transducer 1 may further include a speaker for transducing an electrical signal generated by the terminal 2 into a sound.

The terminal 2 is, for example, a game device, an audio device, a communication device, a smart phone, or a computer. The acoustic-electric transducer 1 is attachable to/detachable from the terminal 2, and outputs a transduced electrical signal to the terminal 2 while the acoustic-electric transducer 1 is connected to the terminal 2. The terminal 2 processes an electrical signal inputted from the acoustic-electric transducer 1. For example, the terminal 2 transduces the inputted electrical signal into a sound or transfers the inputted electrical signal to other devices.

A Configuration of the Acoustic-Electric Transducer 1

Figure 2:
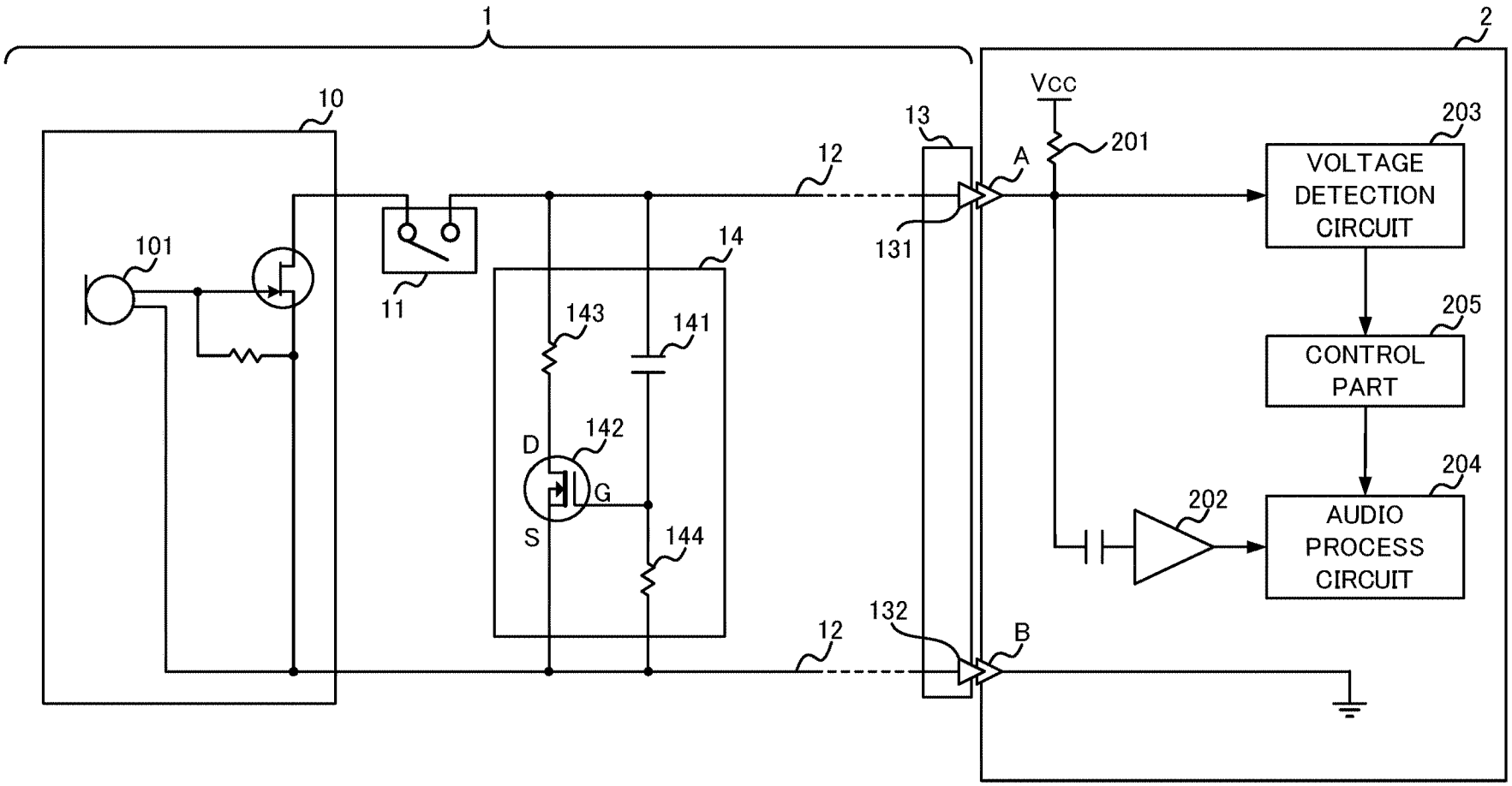
FIG. 2 shows a configuration of the acoustic-electric transducer and a terminal.

FIG. 2 shows a configuration of the acoustic-electric transducer 1 and the terminal 2. The acoustic-electric transducer 1 includes a sound input part 10, a changeover switch 11, a cable 12, a connection part 13, and a current control circuit 14.

The sound input part 10 has a microphone 101 which is an acoustic-electric transducing part that transduces the sound inputted from the outside into the electrical signal. The microphone 101 is, for example, an electret condenser microphone.

The changeover switch 11 switches between a non-mute state where a sound-transduced electrical signal is outputted to the terminal 2 and a mute state where the sound-transduced electrical signal is not outputted to the terminal 2. The changeover switch 11 conducts in the non-mute state and the acoustic-electric transducer 1 can receive power from the terminal 2. In the non-mute state, the electrical signal generated by the microphone 101 is inputted to the terminal 2 via the changeover switch 11, the cable 12, and the connection part 13. The changeover switch 11 is non-conductive in the mute state and the power from the terminal 2 is not supplied to the acoustic-electric transducer 1. Therefore, in the mute state, the microphone 101 does not transduce the electrical signal even if the sound from an external source is received.

The cable 12 connects the acoustic-electric transducer 1 and the terminal 2. The cable 12 transmits, to the terminal 2, the electric signal transduced from the sound by the microphone 101.

The connection part 13 is, for example, a connector plug provided at a tip end of the cable 12. The connection part 13 has a first connection point 131 and a second connection point 132. The first connection point 131 contacts a first contact A of a connector jack provided to the terminal 2, and the second connection point 132 contacts a second contact B. The connection part 13 complies with, for example, the plug-in power standard and receives the power from the terminal 2. The first contact A is, for example, a metal terminal connected to a power supply (Vcc) of the terminal 2. The second contact B is, for example, a metal terminal connected to a ground of the terminal 2. Therefore, a potential of the first contact A is higher than the potential of the second contact B.

The current control circuit 14 is a circuit that makes a current flow between the first contact A and the second contact B until a predetermined time passes from the time when the acoustic-electric transducer 1 is connected to the terminal 2. The predetermined time is a time that is longer than the minimum time required for the terminal 2 to determine whether the acoustic-electric transducer 1 is connected, and is a time determined by the time constant of the current control circuit 14. The current control circuit 14 is provided between the changeover switch 11 and the connection part 13. The current control circuit 14 has a capacitor 141, an electronic switch 142, a resistor 143 (corresponding to a first resistor), and a resistor 144 (corresponding to a second resistor).

The capacitor 141 is arranged between the first connection point 131 and a gate terminal G of the electronic switch 142. The capacitor 141 is charged by the power supplied from terminal 2.

The electronic switch 142 is, for example, a field effect transistor. A drain terminal D of the electronic switch 142 is electrically connected to the first connection point 131 via the resistor 143. Further, a source terminal S of the electronic switch 142 is electrically connected to the second connection point 132. A voltage of the gate terminal G of the electronic switch 142 increases until the capacitor 141 is completely charged. As a result, a potential difference between the gate terminal G and the source terminal S increases, and a state between the drain terminal D and the source terminal S of the electronic switch 142 becomes a conductive state.

The voltage of the gate terminal G decreases after the capacitor 141 is completely charged, and the state between the drain terminal D and the source terminal S of the electronic switch 142 becomes a non-conductive state. As a result, the electronic switch 142 reduces the current flowing between the first contact A and the second contact B after the predetermined time passes from the time when the connection part 13 is connected to the terminal 2. Since the time required for the state between the drain terminal D and the source terminal S to change from the conductive state to the non-conductive state depends on capacitance of the capacitor 141, the predetermined time is determined by the capacitance of the capacitor 141.

Due to the state between the drain terminal D and the source terminal S of the electronic switch 142 becoming the non-conductive state, the current control circuit 14 enters a high impedance state and does not affect other circuits. The current based on the sound inputted to the microphone 101 flows between the first contact A and the second contact B in this state.

The resistor 143 is arranged between (i) the first connection point 131 and the changeover switch 11 and (ii) the drain terminal D of the electronic switch 142. The resistor 143 prevents a short circuit from occurring between the first contact A and the second contact B when the state between the drain terminal D and the source terminal S of the electronic switch 142 is conductive. The resistor 144 is provided between the second connection point 132 and the capacitor 141. The resistor 144 increases the potential of the gate terminal G in accordance with the magnitude of the current flowing during a time from when the acoustic-electric transducer 1 is connected to the terminal 2 until the predetermined time passes. As a result, the potential of the gate terminal G changes in accordance with the amount of charge of the capacitor 141.

A Configuration of the Terminal 2

Next, a configuration of the terminal 2 will be described with reference to FIG. 2. The terminal 2 includes a resistor 201, an amplifier 202, a voltage detection circuit 203, an audio processing circuit 204, and a control part 205.

The voltage detection circuit 203 detects the voltage of the first contact A. The voltage detection circuit 203 provides notification about the detected voltage of the first contact A to the control part 205. The amplifier 202 amplifies the electrical signal transduced from the sound by the microphone 101. The audio processing circuit 204, for example, executes a process of outputting the sound based on the electrical signal inputted from the amplifier 202 to a speaker or executes a process of transmitting the electrical signal through a communication line.

The control part 205 is, for example, a Central Processing Unit (CPU) and controls respective parts of the terminal 2. If the voltage detected by the voltage detection circuit 203 is equal to or greater than a threshold, the control part 205 determines that the acoustic-electric transducer 1 is not connected to the terminal 2, and if the voltage detected by the voltage detection circuit 203 is less than the threshold, the control part 205 determines that the acoustic-electric transducer 1 is connected to the terminal 2. The threshold is set below the maximum value assumed as the voltage of the first contact A within the predetermined time from the time when the acoustic-electric transducer 1 is connected to the terminal 2. For example, the control part 205 switches between an on state and an off state of a microphone (not shown) built in the terminal 2 on the basis of the voltage of the first contact A detected by the voltage detection circuit 203.

A Voltage Change Due to a Connection of the Acoustic-Electric Transducer 1

Figure 3A:
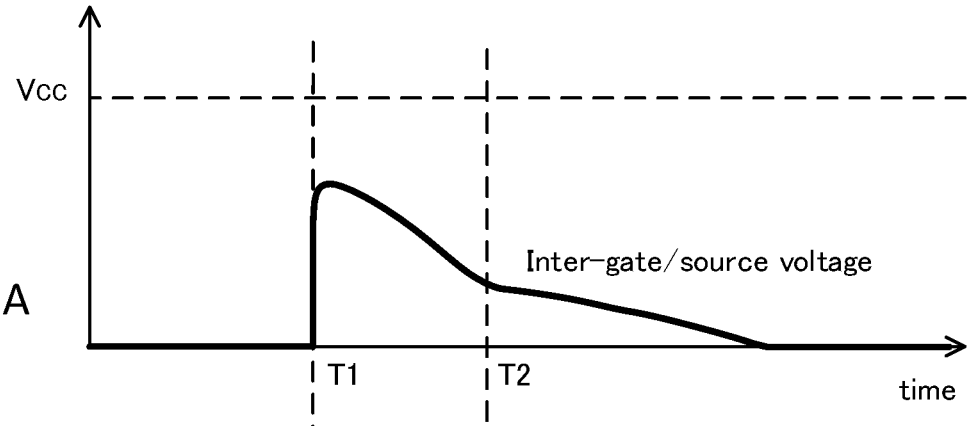
FIGS. 3A and 3B show a change in a voltage when the acoustic-electric transducer is connected to the terminal.
Figure 3B:
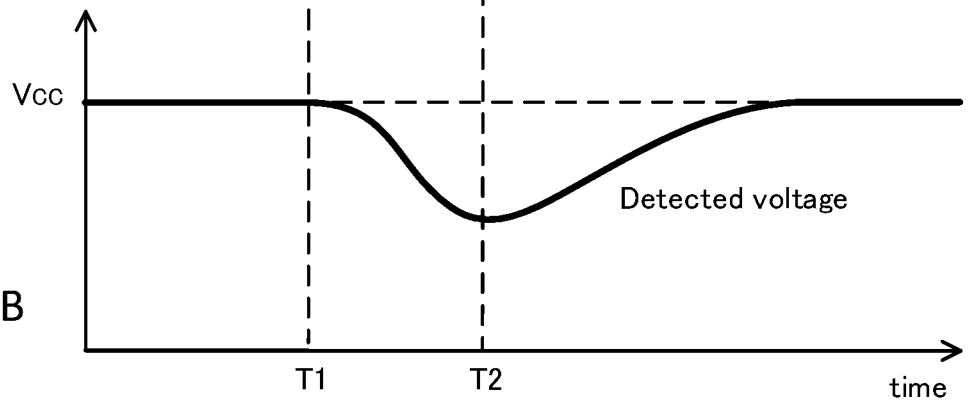

FIGS. 3A and 3B show a change in voltage when the acoustic-electric transducer 1 is connected to the terminal 2. Vcc in FIGS. 3A and 3B is a power supply voltage of the terminal 2. FIG. 3A shows a voltage between the gate terminal G and the source terminal S of the electronic switch 142. FIG. 3B shows the voltage of the first contact A detected by the voltage detection circuit 203. A time T1 in FIG. 3 indicates a time at which the acoustic-electric transducer 1 is connected to the terminal 2.

As shown in FIG. 3A, the voltage between the gate terminal G and the source terminal S of the electronic switch 142 increases due to the power supply from the terminal 2 starting at the time T1. As a result, the state between the drain terminal D and the source terminal S becomes conductive, and so the current flows between the first contact A and the second contact B. As the capacitor 141 accumulates the charge due to the current flowing in, an inter-terminal voltage of the capacitor 141 gradually increases. Therefore, the potential appearing on the gate terminal G side gradually lowers, the voltage between the gate terminal G and the source terminal S gradually decreases, and the electronic switch 142 at a time T2 enters the non-conductive state.

As shown in FIG. 3B, the voltage of the first contact A (i.e., the voltage of the first connection point) starts decreasing from Vcc at the time T1 when the acoustic-electric transducer 1 is connected to the terminal 2, and increases after the electronic switch 142 enters the non-conductive state at the time T2. Thereafter, the voltage of the first contact A reaches Vcc at the time when the current control circuit 14 enters the high-impedance state.

Variations

Although the above description has exemplified a case where the electronic switch 142 is the field effect transistor, the electronic switch 142 may be an NPN bipolar transistor. In this case, the gate terminal, the source terminal, and the drain terminal of the field-effect transistor in FIG. 2 correspond to a base terminal, a collector terminal, and an emitter terminal of the NPN bipolar transistor.

Further, the above description has exemplified the configuration in which the current control circuit 14 controls the current flowing between the first contact A and the second contact B with the electronic switch 142, but the configuration of the current control circuit 14 is not limited thereto. The current control circuit 14 may include a processor that operates by executing software, for example. In this case, the processor, activated by the current supplied from the terminal 2, may reduce the impedance of the circuit provided between the first contact A and the second contact B to make the current flow between the first contact A and the second contact B. The processor increases the impedance of the circuit provided between the first contact A and the second contact B to interrupt the current after the predetermined time passes.

Effects of the Acoustic-Electric Transducer 1

According to the acoustic-electric transducer 1 according to the present embodiment, the current control circuit 14 makes the current flow between the first contact A and the second contact B until the predetermined time passes from the time when the connection part 13 is connected to the terminal 2. Therefore, the control part 205 of the terminal 2 can determine, on the basis of the voltage detected by the voltage detection circuit 203, whether the acoustic-electric transducer 1 is connected. Further, the current control circuit 14 reduces the current flowing between the first contact A and the second contact B after the predetermined time passes, and enters the high-impedance state. Therefore, the current control circuit 14 does not affect characteristics of the electrical signal generated by the microphone 101.

The present invention is explained on the basis of the exemplary embodiments. The technical scope of the present invention is not limited to the scope explained in the above embodiments and it is possible to make various changes and modifications within the scope of the invention. For example, all or part of the apparatus can be configured to be functionally or physically distributed and integrated in arbitrary units. Further, new exemplary embodiments generated by arbitrary combinations of them are included in the exemplary embodiments of the present invention. The effect of the new embodiment caused by the combination has the effect of the original embodiment together.

What is claimed is:

1. An acoustic-electric transducer for transducing a sound into an electrical signal, comprising:

a connection part that has a first connection point able to contact a first contact in a terminal for processing the electrical signal, and a second connection point able to contact a second contact having a potential lower than the potential of the first contact;

an acoustic-electric transducing part that transduces a sound inputted from an external source into an electrical signal;

a changeover switch that is provided on a first transmission line where the electrical signal is transmitted to the terminal and switches between a non-mute state where the electrical signal is outputted to the terminal and a mute state where the electrical signal is not outputted to the terminal; and a current control circuit that makes a current flow between the first contact and the second contact until a predetermined time that is longer than a minimum time required for the terminal to determine whether the acoustic-electric transducer is connected passes from the time when the connection part is connected to the terminal and reduces the current flowing between the first contact and the second contact after the predetermined time passes, the current control circuit being provided between the changeover switch and the connection part and also between the first transmission line and a second transmission line that is paired with the first transmission line and connected to a ground of the terminal.

2. The acoustic-electric transducer according to claim 1, wherein the current control circuit includes:

a capacitor that is charged by a current supplied from the terminal, and an electronic switch that sets a state between the first connection point and the second connection point to a conductive state until the capacitor is completely charged, and sets the state between the first connection point and the second connection point to a non-conductive state after the predetermined time passes.

3. The acoustic-electric transducer according to claim 2, wherein the electronic switch is a field effect transistor, the capacitor is provided between the first connection point and a gate terminal of the field effect transistor, a drain terminal of the field effect transistor is electrically connected to the first connection point, and a source terminal of the field effect transistor is electrically connected to the second connection point.

4. The acoustic-electric transducer according to claim 3, wherein the current control circuit further includes:

a first resistor provided between (i) the changeover switch and the first connection point and (ii) the drain terminal of the field effect transistor.

5. The acoustic-electric transducer according to claim 4, wherein a voltage of the gate terminal increases until the capacitor is completely charged.

6. The acoustic-electric transducer according to claim 5, wherein a potential difference between the gate terminal and the source terminal increases until the capacitor is completely charged, and a state between the drain terminal and the source terminal becomes a conductive state.

7. The acoustic-electric transducer according to claim 5, wherein the voltage of the gate terminal decreases after the capacitor is completely charged, and the state between the drain terminal and the source terminal becomes a non-conductive state.

8. The acoustic-electric transducer according to claim 4, wherein the current control circuit enters a high impedance state due to the state between the drain terminal and the source terminal becoming a non-conductive state.

9. The acoustic-electric transducer according to claim 4, wherein the current control circuit further includes:

a second resistor provided between the second connection point and the capacitor.

10. The acoustic-electric transducer according to claim 9, wherein the second resistor increases a potential of the gate terminal in accordance with the magnitude of the current flowing during a time from when the acoustic-electric transducer is connected to the terminal until the predetermined time passes.

11. The acoustic-electric transducer according to claim 2, wherein the voltage of the first connection point starts decreasing from a power supply voltage of the terminal at the time when the acoustic-electric transducer is connected to the terminal, and increases after the electronic switch enters a non-conductive state.

12. The acoustic-electric transducer according to claim 11, wherein the voltage of the first connection point reaches the power supply voltage of the terminal at the time when the current control circuit enters a high impedance state.

13. An acoustic-electric transducer for transducing a sound into an electrical signal, comprising:

a connection part that has a first connection point able to contact a first contact in a terminal for processing the electrical signal, and a second connection point able to contact a second contact having a potential lower than the potential of the first contact;

an acoustic-electric transducing part that transduces a sound inputted from an external source into an electrical signal;

a changeover switch that switches between a non-mute state where the electrical signal is outputted to the terminal and a mute state where the electrical signal is not outputted to the terminal; and a current control circuit that makes a current flow between the first contact and the second contact until a predetermined time passes from the time when the connection part is connected to the terminal and reduces the current flowing between the first contact and the second contact after the predetermined time passes, the current control circuit being provided between the changeover switch and the connection part, wherein the current control circuit includes:

a capacitor that is charged by a current supplied from the terminal, a field effect transistor that sets a state between the first connection point and the second connection point to a conductive state until the capacitor is completely charged, and sets the state between the first connection point and the second connection point to a non-conductive state after the predetermined time passes, a first resistor provided between (i) the changeover switch and the first connection point and (ii) the drain terminal of the field effect transistor, and a second resistor provided between the second connection point and the capacitor, wherein the capacitor is provided between the first connection point and a gate terminal of the field effect transistor, a drain terminal of the field effect transistor is electrically connected to the first connection point, a source terminal of the field effect transistor is electrically connected to the second connection point, and the second resistor increases a potential of the gate terminal in accordance with the magnitude of the current flowing during a time from when the acoustic-electric transducer is connected to the terminal until the predetermined time passes.

14. An acoustic-electric transducer for transducing a sound into an electrical signal, comprising:

a connection part that has a first connection point able to contact a first contact in a terminal for processing the electrical signal, and a second connection point able to contact a second contact having a potential lower than the potential of the first contact;

an acoustic-electric transducing part that transduces a sound inputted from an external source into an electrical signal;

a changeover switch that switches between a non-mute state where the electrical signal is outputted to the terminal and a mute state where the electrical signal is not outputted to the terminal; and a current control circuit that makes a current flow between the first contact and the second contact until a predetermined time passes from the time when the connection part is connected to the terminal and reduces the current flowing between the first contact and the second contact after the predetermined time passes, the current control circuit being provided between the changeover switch and the connection part, wherein the current control circuit includes:

a capacitor that is charged by a current supplied from the terminal, and an electronic switch that sets a state between the first connection point and the second connection point to a conductive state until the capacitor is completely charged, and sets the state between the first connection point and the second connection point to a non-conductive state after the predetermined time passes, and wherein the voltage of the first connection point starts decreasing from a power supply voltage of the terminal at the time when the acoustic-electric transducer is connected to the terminal, and increases after the electronic switch enters a non-conductive state.

* * * * *